United States Patent [19]

Theurer et al.

[11] 4,152,989

[45] May 8, 1979

[54] MOBILE APPARATUS FOR CONTINUOUSLY LAYING TIES

[75] Inventors: Josef Theurer, Vienna; Manfred Brunninger, Linz, both of Austria

[73] Assignee: Franz Plasser Bahnbaumaschinen-Industriegesellschaft, m.b.H., Vienna, Austria

[21] Appl. No.: 845,388

[22] Filed: Oct. 25, 1977

[30] Foreign Application Priority Data

Feb. 23, 1977 [AT] Austria ..... 1210/77

[51] Int. Cl.[2] ..... E01B 27/11; E01B 29/05

[52] U.S. Cl. ..... 104/2; 37/104; 104/6; 171/16

[58] Field of Search ..... 104/2, 3, 4, 5, 6, 7 R, 104/7 A, 7 B; 171/16; 37/104

[56] References Cited

U.S. PATENT DOCUMENTS

| | | | |
|---|---|---|---|
| 2,914,867 | 12/1959 | Scheuchzer et al. | 37/104 |
| 3,654,868 | 4/1972 | Plasser et al. | 104/2 |
| 3,699,894 | 10/1972 | Plasser et al. | 104/2 |
| 3,807,310 | 4/1974 | Erna et al. | 104/2 |
| 4,080,903 | 3/1978 | Cicin-Sain | 104/6 |
| 4,094,249 | 6/1978 | Theurer et al. | 104/2 X |

*Primary Examiner*—L. J. Paperner
*Assistant Examiner*—Randolph A. Reese
*Attorney, Agent, or Firm*—Kurt Kelman

[57] ABSTRACT

A mobile track renewal train comprises a bridge-like elongated carrier frame supported on an old and a new track section on respective on-track undercarriages and bridging an intermediate trackless ballast bed section. A chain guide including a transversely extending guide section is mounted on the carrier frame and encloses a space, the chain guide rising from the transverse guide section adjacent the ballast bed on an upper portion, and an endless excavating chain is supported for movement in the chain guide to excavate ballast from the bed. The carrier frame also supports a tie laying device for laying new ties in a position extending transversely to the carrier frame and a conveyor for transporting the new ties in succession to the tie laying device, the tie laying device being positioned in the enclosed space and the conveyor having a path extending through the space towards the tie laying device.

20 Claims, 7 Drawing Figures

MOBILE APPARATUS FOR CONTINUOUSLY LAYING TIES

The present invention relates to a mobile apparatus for continuously laying a succession of ties in an assembly-line track renewal operation. As is known, such apparatus may consist of a train assembly continuously advancing along a right of way with a succession of carrier frame cars moving respectively on an old and a new track section, with an intermediate trackless ballast bed section wherein means is mounted for removing the old track rails and ties, for excavating and smoothing the ballast, for conveying a succession of new ties and for laying the successive ties on the smoothed ballast, and for laying the new track rails on the newly laid ties, conveyors being mounted on the carrier frame cars for transporting the old and new ties, and for guiding the old and new track rails. In certain types of mobile track renewal apparatus, sections of track consisting of the rails fastened to the ties are removed and replaced by like assembled track sections.

U.S. Pat. No. 3,699,894, dated Oct. 24, 1972, discloses a track renewal train assembly wherein an endless ballast excavating chain is mounted between the pick-up station for the old ties and the tie laying station for the new ties to excavate and smooth the ballast bed in the intermediate trackless ballast bed section. To avoid deposition of the excavated ballast adjacent the ends of the track ties, endless conveyor band arrangements are provided to distribute the excavated ballast in the region of the newly laid ties. One of these ballast conveyors is mounted above the new tie laying device and extends to the adjacent carrier frame car, ballast distributing chutes being mounted at the end of the conveyor for depositing the ballast in the region of the newly laid ties. This arrangement has been successfully used in assembly-line track renewal operations since the intermediate storage of the ballast at the tie ends is eliminated. In some instances, however, space limitations have caused difficulties since the ballast conveyors are relatively bulky.

It is the primary object of this invention to overcome such difficulties by redesigning the path of the tie conveyor and of the ballast so that they occupy a compact space and considerably facilitate and simplify the ballast excavation and cleaning.

This and other objects are accomplished in accordance with the invention with a mobile apparatus for continuously laying a succession of ties, which comprises a bridge-like elongated carrier frame, at least one undercarriage supporting the carrier frame, and an arrangement for excavating ballast from a bed and for smoothing the ballast bed, the ballast excavating arrangement including a chain guide including a transversely extending guide section mounted on the carrier frame and rising from the transverse guide section adjacent the ballast bed to an upper portion, and an endless ballast excavating chain supported for movement in the chain guide. The chain guide encloses a space and means for conveying and laying the succession of ties in a position extending transversely to the carrier frame has a path extending through the space enclosed by the chain guide.

Since the tie conveying and laying means has a path extending through the generally rectangular enclosed space, no ballast conveyors are required to transport the excavated ballast from the excavating arrangement.

With ballast outlets and distributing chutes associated with the upper portion of the chain guide, the ballast excavating arrangement itself serves not only for excavating and smoothing the ballast but also to transport it to the desired outlet region. Furthermore, the tie conveying path is shortened considerably and the ties can be laid immediately adjacent the point of ballast excavation. Thus, the entire apparatus is more compact and shorter.

The above-described apparatus is used with particular advantage in a mobile apparatus for continuously replacing an old track by a new track as the apparatus advances along a right of way including an old track section, a new track section and an intermediate trackless ballast bed section wherein the old ties are replaced by new ties in assembly-line fashion while the track rails are guided without friction off the ballast bed section during the track renewal operation.

The above and other objects, advantages and features of the present invention will become more apparent from the following detailed description of certain now preferred embodiments thereof, taken in conjunction with the accompanying drawing wherein FIGS. 1 and 2 show schematic side views of the mobile apparatus for the continuous replacement of ties according to this invention, the apparatus being broken off at line II—II of FIG. 1 and continuing at corresponding line I—I of FIG. 2;

Figure 1:
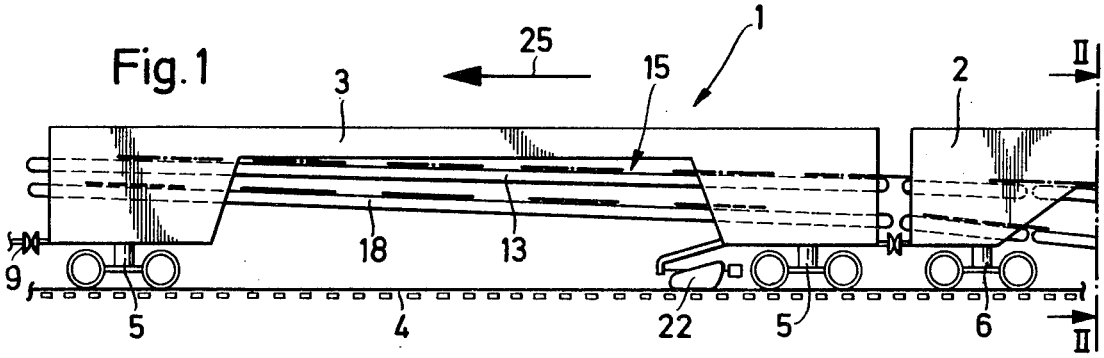
Figure 2:
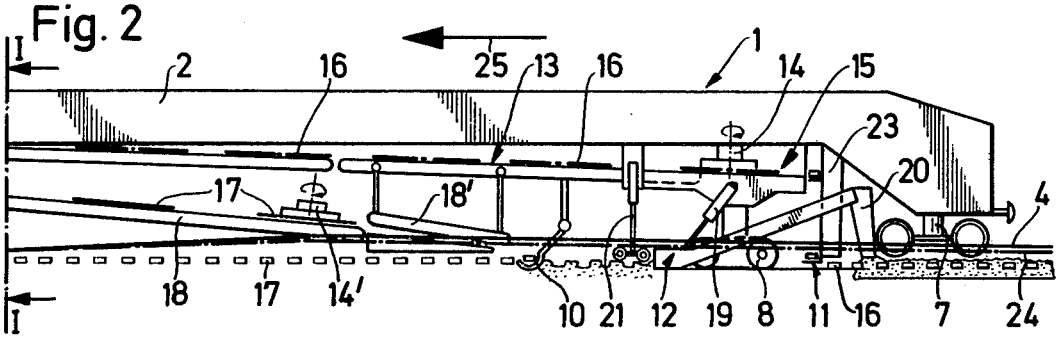

Referring now to the drawing and first to FIGS. 1 and 2, there is shown mobile apparatus 1 for continuously laying a succession of new ties 16, (shown in chain-dotted lines) as the apparatus continuously advances in the direction of arrow 25. The apparatus comprises first bridge-like elongated carrier frame 3 having on-track undercarriages 5, 5 supporting carrier frame 3 on old track section 4, and a like, second bridge-like elongated carrier frame 2 having an on-track undercarriage 6 supporting carrier frame 2 on the old track section, another on-track undercarriage 7 supporting carrier frame 2 on new track section 24, and off-track track laying undercarriage 8 selectively supporting the second carrier frame on an intermediate trackless ballast bed section wherein old ties 17 are replaced by new ties 16. In the operating position illustrated undercarriage 8 is lowered into engagement with the ballast bed for support of carrier frame 2, in which position one-track undercarriage 7 is lifted off the track. As is well known in track renewal trains and, therefore, only schematically indicated, a series of transport cars 9 for ties and rails are coupled to carrier frame 3.

Figure 3:
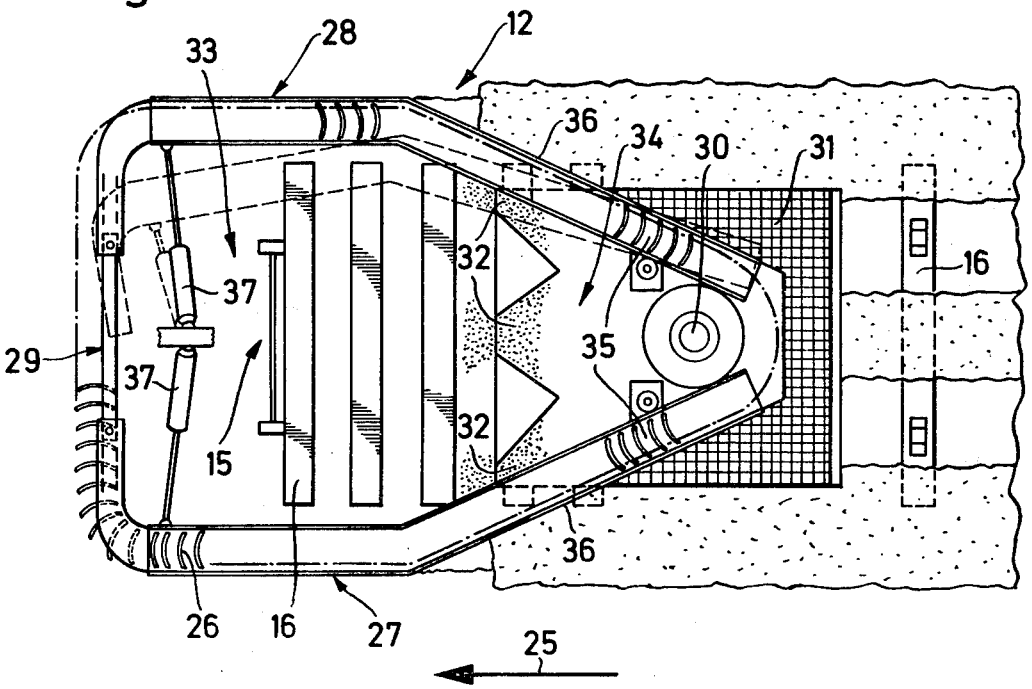
FIG. 3 is an enlarged top view of a portion of the mobile apparatus showing one embodiment of a ballast excavating arrangement in accordance with the invention.
Figure 4:
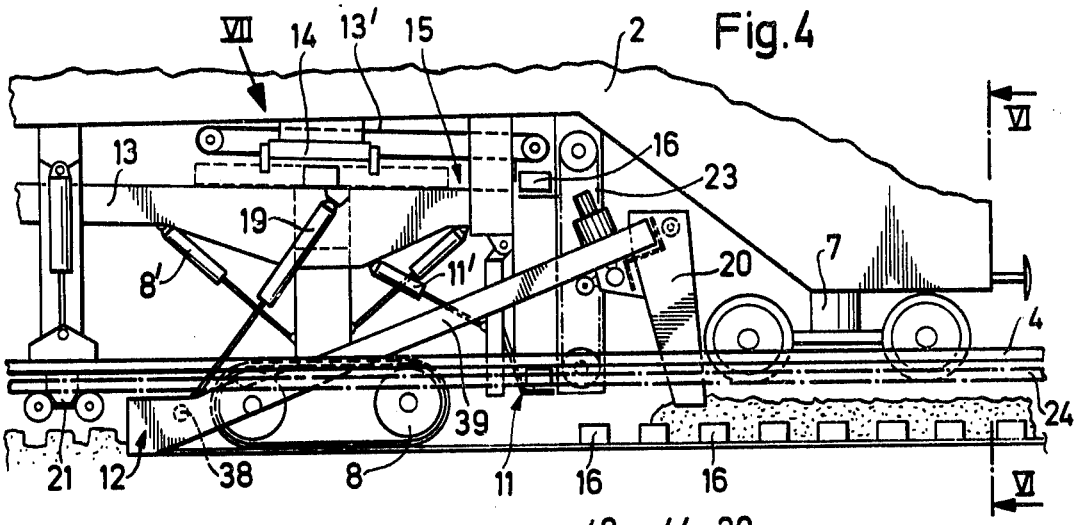
FIG. 4 is an enlarged side view of the same apparatus portion showing another embodiment and additional structural details.
Figure 5:
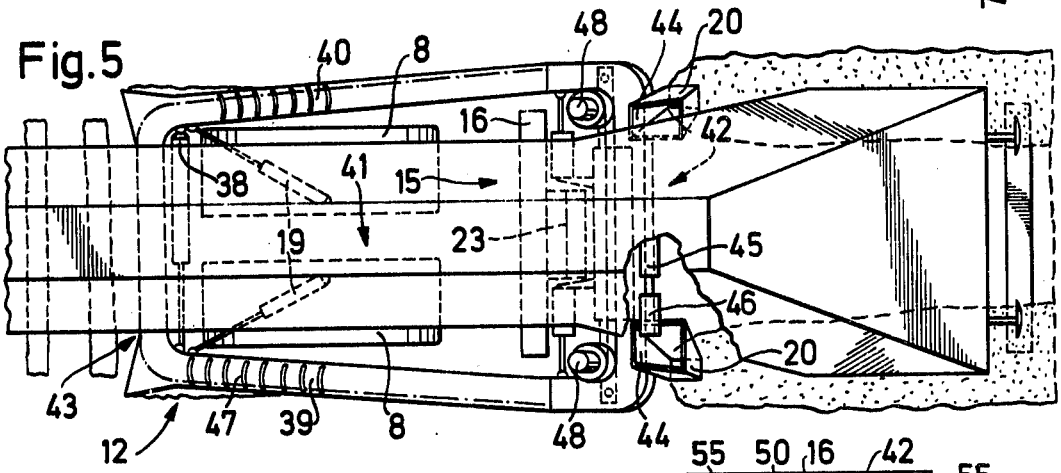
FIG. 5 is a top view of the embodiment of FIG. 4.

Second carrier frame 2 supports device 11 for laying a succession of new ties 16 in a position extending transversely to the carrier frame, and arrangement 12 for excavating ballast from the bed and for smoothing the ballast bed. Arrangements 12 includes a chain guide including a transversely extending guide section mounted on the carrier frame, the chain guide enclosing a space and rising, as shown in FIGS. 2 and 4, from the transverse guide section adjacent the ballast bed to an upper portion thereof, and endless ballast excavating chain 26 supported for movement in the chain guide. Specific embodiments of such arrangements according to the present invention are illustrated in FIGS. 3 and 5, in which connection they will be described hereinbelow. The tie laying device 11 and means 13 for conveying the ties define tie conveying path 15 extending through the enclosed space. In the illustrated embodiment, turntable 14 is also arranged in path 15 between tie laying device 11 and conveyor means 13 for the new ties, the turntable being arranged to receive successive ties 16 from the conveyor means, which conveys the ties in a direction substantially parallel to the elongation of carrier frame 2, and to turn the same into a position extending transversely to the carrier frame, the tie laying device being arranged to receive the turned new ties from turntable 14.

The second carrier frame in the illustrated embodiment also supports pick-up device 10 for removing old ties 17, and means 18 for conveying the old ties from the pick-up device in a direction substantially parallel to the elongation of carrier frame 2, turntable 14' being arranged between tie pick-up device 10 and conveyor means 18 to receive successive ties 17 from the pick-up device and to turn the same into a position extending in this direction. The turntables may be of a construction disclosed in U.S. Pat. No. 3,613,598, dated Oct. 19, 1971.

The illustrated conveying means comprises a series of successive conveyors for transporting the new ties and a series of successive conveyors transporting the old ties, the conveyors being mounted on the carrier frame in superposed relationship, conveyors 13 for transporting the new ties 16 extending in a plane above that of conveyors 18 for transporting the old ties 17 from the enclosed space. The conveyors 13 and 18 are driven in opposite directions, for instance by hydraulic motors.

The chain guide of ballast excavating arrangement 12 is mounted on carrier frame 2 by hydraulic motor 19 enabling the vertical position of the ballast excavating arrangement to be adjusted. The transverse position of ballast excavating arrangement 12 is determined and fixed by cooperating gliding elements between the chain guide and off-track undercarriage 8. The chain guide forms a trough wherein the excavated ballast is moved by the endless chain upwardly and, adjacent the upper portion of the chain guide, ballast distributing chutes 20 are mounted to receive the excavated ballast and suitably distribute it in the region of the newly laid ties 16 (see FIGS. 4 and 5).

The illustrated embodiment of the mobile apparatus also comprises auxiliary on-track bogie 21 mounted on carrier frame 2 immediately adjacent the chain guide of ballast excavating arrangement 12 between off-track track laying undercarriage 8 and on-track undercarriage 6 supporting carrier frame 2 on old track 4.

The illustrated embodiment also comprises means 22 for picking up and removing tie fastening elements, such as nuts and bolts or spikes, which is arranged forwardly of ballast excavating arrangement 12, for example in the region of one of the undercarriages 5, as shown in FIG. 1. Means 22 may comprise a magnetic roll and a transverse conveyor receiving picked-up tie fastening elements from the roll and dropping them into a container.

The track renewal train hereinabove described operates in the following manner:

As the train including carrier frame 2 and 3 advances continuously in the direction of arrow 25, device 10 picks up one old tie 17 after another, places the successive ties on intermediate conveyor 18' which moves the ties to turntable 14', wherein the ties extending transversely to the carrier frame are turned 90° into a position extending parallel to the elongation of the carrier frame, in which position they are received and transported by the succession of conveyors 18 to the forward end of first carrier frame 3 whence they are further transported to adjacent cars 9 in a known manner forming no part of the present invention. If desired, pallets may be used for turning the ties.

At the same time, a succession of conveyors 13 transport new ties 16, received from freight cars 9, in a position extending parallel to the elongation of the carrier frames to turntable 14, which turns the ties 90° into a position extending transversely to the carrier frame, in which position new ties 16 are received by vertical conveyor 23 which takes them to track laying device 11 which positions the ties on the smoothed and partially compacted ballast bed. Smoothing and compaction of the ballast is accomplished by ballast excavating arrangement 12 in cooperation with track laying undercarriage 8 whose full tracks press against the ballast bed and compact the ballast underneath. The excavated ballast is distributed immediately behind tie laying device 11 by chutes 20 along the newly laid ties. This arrangement enables the track renewal site, i.e. the section between the pick-up of the old ties and the laying of the new ties, as well as the redistribution of the excavated ballast, to be relatively short. This, in turn, makes it possible to shorten the overall length of carrier frame 2 as well as the distances between the undercarriages supporting it. Such a shortened carrier frame can be moved with relative ease and facilitates its incorporation into a train assembly.

As has been fully disclosed, for example, in U.S Pat. Nos. 3,330,219, dated July 11, 1967, 3,521,565, dated July 21, 1970, and 3,633,513, dated Jan. 11, 1972, old track rails 4 new rails 24 (shown in chain-dotted lines) stored in the region of the old track are lifted off old ties 17, are spread apart over the intermediate trackless ballast bed section a distance exceeding the length of the ties, and guided without friction by a series of guide rollers. Behind undercarriage 7, the new rails are moved together again to assume the desired track gauge, in which position they are laid on newly laid ties 16 and fastened thereto. The old rails may be stored next to the new rails for later removal or they may be transported continuously to flat cars coupled to carrier frame 2 to be carried away with the track renewal train. All of this operation may be conventional and forms no part of the invention. The shortened track renewal section provided by this invention in the manner explained hereinabove also shortens the path over which rails 4 and 24 must be spread, which is an added advantage.

Upon conclusion of a track renewal operation, auxiliary on-track bogie 21 is lowered into engagement with old track 4 so that carrier frame 2 will run on undercarriage 6 and bogie 21 on the track, while off-track undercarriage 8 is lifted by hydraulic motors 8' and ballast excavating arrangement 12 is lifted by hydraulic motor 19 into inoperative position. The train is then moved in the direction of arrow 25 until rear undercarriage 7 also engages old track 4. At this point, the auxiliary bogie is lifted again so that on-track undercarriage 7 fully supports the rear end of carrier frame 2 on the track. At the beginning of a track renewal operation, carrier frame 2 is advanced on undercarriage 7 until off-track undercarriage 8 can be lowered onto the smoothed ballast bed.

In the embodiment of FIG. 3, the space enclosed by the chain guide of arrangement 12 for excavating ballast comprises substantially rectangular space section 33 adjacent transverse guide section 29 and adjoining triangular section 34 adjacent the upper portion of the chain guide. Central drive 30 is mounted at the upper portion for moving the endless ballast excavating chain in the guide and thus to move the excavated ballast in the trough-shaped guide from the transverse guide section to the upper portion where the ballast is discharged onto ballast cleaning screen arrangement 31 mounted to receive the excavated ballast from the endless excavating chain adjacent the upper portion of the chain guide. The screened ballast then passes through a ballast conveying means illustrated as chutes 32 mounted to receive the screened ballast from the screen and to distribute the same. This embodiment has the advantage of requiring only a single central drive for the endless ballast excavating chain while holding the number of chain guide sections to a minimum. Also, it provides a single discharge point for the excavated ballast from the chain guide.

As can be seen from FIG. 3, ballast distributing chutes 32 are so arranged as to deposit the cleaned ballast in three strips parallel to the track, i.e. one ballast strip in the center and two at respective sides of the ballast bed. This has the advantage of keeping the areas of newly laid ties 16 where new rails 24 are fastened to the ties free of ballast so that the fastening of the rails may proceed without hindrance. As is well known, the waste material is suitably conveyed away from screen 31. The new ties are laid along path 15 schematically indicated in FIG. 3 within rectangular space 33 whose width exceeds the length of the ties so as to permit passage of the ties through this space. This space is defined by transverse guide section 29 and two lateral guide sections 27, 28 extending substantially in the direction of carrier frame 2 while adjoining triangular space 34 is defined by converging guide sections 36 which guide chain portion 35 which is engaged by drive 30 which drives the chain in an endless path in the chain guide.

As shown, transverse guide section 29 comprises a central portion telescopingly guided in respective end portions of this chain guide section. Hydraulic motors 37 are linked to lateral chain guide sections 27 and 28 to enable the width of rectangular space 33 to be adjusted after the connection between the central and end portions of guide section 29 has been loosened to enable gliding of these portions in relation to each other. As indicated in broken lines, the central portion of transverse guide section 29 may be removed entirely when the apparatus is not in operation and moved from one site to another, and the lateral chain guide sections may be moved inwardly by motors 37 so as to reduce the transverse section of the apparatus.

Figure 6:
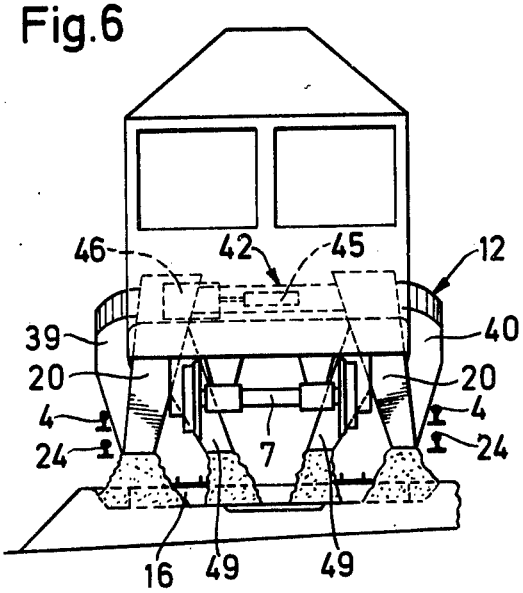
FIG. 6 is a front view along line VI—VI of FIG. 4.

FIGS. 4 to 6 show only that part of the mobile apparatus of FIGS. 1 and 2 which holds the ballast excavating arrangement and the tie laying station associated therewith. In this embodiment, the space 41 enclosed by the chain guide is substantially rectangular, this space having a width exceeding the length of new ties 16. A pair of hydraulic drives 48 for moving endless ballast excavating chain 47 in the chain guide is mounted in respective corners of the rectangular space at the upper portion of the chain guide. Ballast outlets 44 are positioned between the chain drives in the upper portion of the chain guide and direct the excavated ballast (as best shown in FIG. 6) to the sides of the track, leaving the portions of ties 16 to which the new rails are fastened free of ballast. This arrangement makes it possible to distribute the ballast suitably over selected portions along the new ties by a suitable arrangement of the outlets and ballast distributing chutes cooperating therewith. No further ballast conveying means is required for this purpose.

As best seen in FIG. 4, successive new ties 16 are transported by conveyor 13′ from turntable 14, which has turned them into a position extending transversely to the carrier frame, to vertical conveyor 23 which deposits the ties successively on tie laying device 11 which is pivotal by hydraulic motor 11′ about a transverse pivot in the direction of elongation of carrier frame 2. Hydraulic motors 8′ serve to move off-track undercarriage 8 vertically and also to guide this undercarriage.

Thus, off-track undercarriage 8 is also positioned within space 41 enclosed by the chain guide and tie laying device 11 is arranged immediately adjacent the upper portion of the chain guide between this portion and undercarriage 8. Thus, the track renewal site itself, i.e. the distance between the ballast excavation and the point where the new tie is laid, is relatively short but, nevertheless, the endless treads of the track laying undercarriage move on a smoothed portion of the ballast bed and compact two strips of the bed before the new ties are laid, these compact ballast strips subsequently serving as supports for the new rails fastened to the newly laid ties.

The proper level of the smoothed ballast bed may be adjusted by vertically moving ballast excavating arrangement 12 by means of hydraulic motors 19 and the width of space 41 may be adjusted by means of hydraulic motor 38 linked to lateral chain guide sections 39, 40. For the purpose of this adjustment, the upper ends of elongated chain guide sections 39, 40 are pivoted to the upper chain guide section 42 at pivots 57 while the lower transverse guide section 43 may be comprised of telescoping portions, as shown in FIG. 3. Pivots 57 are spaced a distance at least equal to the length of ties 16. This makes it possible to arrange tie laying device 11 close to the upper portion of the excavating chain guide since space 41 is wide enough at this point to permit passage of the ties therethrough in their transverse position.

FIGS. 5 and 6 illustrate the ballast distributing chutes associated with ballast outlet means 44 for receiving the excavated ballast therefrom and to deposit it in strips along the right of way, which chutes are arranged between on-track undercarriage 7 and tie laying device 11. Two ballast outlets 44 are defined in upper chain guide portion 42 to direct ballast from the trough-shaped chain guide into side chutes 20 which distribute the ballast in two strips extending in a longitudinal direction along the ends of ties 16. The ballast outlets are positioned in the respective end regions of chain guide portion 42 and the outlet closer to chain guide section 39 has gate 46 adjustable by hydraulic motor 45. This makes it possible to adjust the amount of excavated ballast discharged through outlets 44. As is shown in FIG. 6, additional ballast distributing chutes 49 may also be arranged to receive ballast from outlets 44 to deposit two additional strips of ballast in the center of the bed. The regions where the new rails are fastened to the new ties are between the pairs of ballast strips and remain free of ballast. This ballast distributing chute arrangement provides a very favorable ballast distribution with very simple mechanical means requiring a minimum of space. Adjustments in the amount of distributed ballast is effected very simply by operation of a single movable part, i.e. adjustable gate 46.

Figure 7:
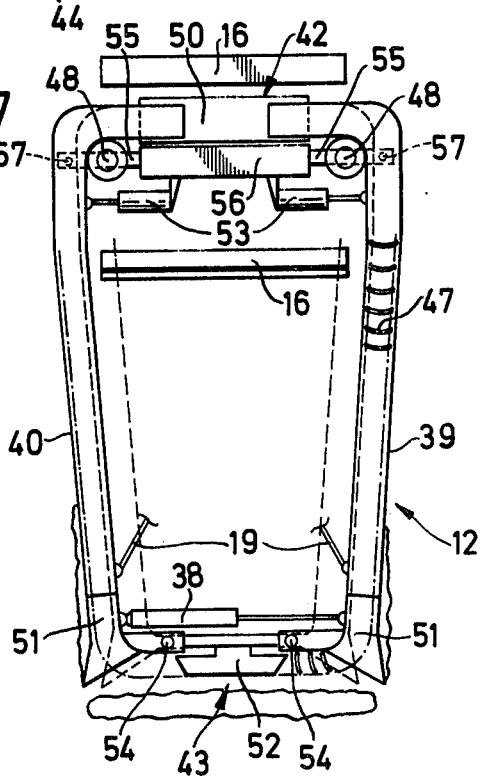
FIG. 7 is a top view of the embodiment of FIG. 4, seen in the direction of arrow VII in FIG. 4.

As can be seen in FIG. 7, upper transverse chain guide section 42 as well as lower transverse chain guide section 43 are comprised of several telescopingly interengaging parts slidable in relation to each other for adjusting the length of these guide sections and, thus the width of space 41. This enables ballast excavating arrangement 12 to be reduced in width (to the position shown in broken lines) when the apparatus is inoperative and moved from one working site to another. As illustrated, the upper transverse chain guide section has a central portion 50 telescopingly engaging inwardly bent portions of lateral chain guide sections 39 and 40 while corner pieces 51 there-of cooperate with chain support part 52 to provide an adjustable lower chain guide section. Hydraulic motors 53 are linked to chain guide sections 39, 40 and hydraulic motor 38 is linked to corner pieces 51 to adjust the width of the chain guide and to hold at in the adjusted width. As shown, the chain guide is further braced by threaded bolt or spindle connection 54.

It is advantageous to provide central chain support part 52 with a downwardly projecting plow blade so as to provide a central ballast bed portion recessed in relation to the two side portions of the ballast bed serving to support the rails (see FIG. 6). This will avoid "riding" of the ties during subsequent use of the newly laid track.

The ballast outlet and chute means have not been shown in FIG. 7 so that the figure may better illustrate guide bars 55 supporting the upper ends of chain guide sections 39 and 40. These guide bars are transversely slidably journaled in housing 56 affixed to carrier frame 2 and are pivotal about transverse axes. The two chain guide sections are also pivotal about vertical pivots 57 mounted on guide bars 55.

The preferred use of the illustrated tie laying apparatus is in an otherwise conventional track renewal train wherein an old track is replaced by a new track in an assembly-line operation while the train moves continuously along the right of way. The use of the two bridge-like elongated carriers frames 3 and 2, with their cooperating conveyor means for transporting the old ties 17 and new ties 16, the ballast excavating arrangement 12, the tie laying device 11 within the enclosed space defined by the chain guide of this arrangement, and turntables 14 and 14' which suitably change the positioning of the ties makes it possible to effect the track renewal proper in a relatively short space while the transport tie conveyors on the two carrier frames have sufficient storage space so that the renewal operation can continue without interruption even if there are minor disturbances in the conveyance of the ties.

As is well known in assembly-line track renewal operations, forward cars 9 carry suitable apparatus for removing the fastening elements between old rails 4 and old ties 17 to enable the old rails to be lifted and the old ties to be removed by pick-up device 10. Such apparatus has been disclosed, for example, in U.S. Pat. No. 3,680,486, dated Aug. 1, 1972, and No. 3,690,264, dated Sept. 12, 1972. The loosened rails 4 are lifted by means of guide rollers and are guided while being spread aparts along the sides of carrier frame 2. The transport of ties 16 and 17 is normally automated in a suitable manner, such as described in U.S. Pat. No. 3,638,577, dated Feb. 1, 1972. While FIGS. 1 and 2 illustrate delivery of the new ties and removal of the old ties in the same, forward direction by oppositely moving conveyors, it is also possible to transport the old and new ties to the renewal station from opposite directions, as described in U.S. Pat. No. 3,699,894 and No. 3,807,310, dated Apr. 30, 1974. After the new ties have been laid, the new rails are fastened thereto in a subsequent operation, for instance in a manner described in the cited patents.

If the new track is to be laid in sections, with the rails attached to the ties, the space enclosed by ballast excavating arrangement 12 must be so dimensioned that these track sections may be passed therethrough.

Where the conveyor means comprises, as illustrated in FIGS. 1 and 2, conveyor 13 for transporting the new ties 16 and conveyor 18 for transporting old ties 17 and the conveyors are mounted in superposed relationship, conveyor 13 extending in a plane above that of conveyor 18 from the space enclosed by the chain guide towards first carrier frame 2, and the conveyors are driven in opposite directions, both groups of ties may be stored on freight cars coupled to the front of the train so that the cars from which the new ties are delivered may be used for storing the old ties. This further decreases the length of the track renewal train since it cuts the number of cars needed for the transport of ties in half.

Where, as described and illustrated, the chain guide comprises a trough-like portion for the excavated ballast, the excavating chain moves the ballast in the chain guide from the transversely extending lower guide section to outlets in the upper portion thereof, and the conveyor for transporting the new ties 16 intersects the upper chain guide portion in the region between off-track track laying undercarriage 8 and on-track undercarriage 7, favorable load distribution conditions over the end region of carrier frame 2 are assured not only at the beginning of the renewal operation, when the carrier frame is still supported on the old track but also during the subsequent continuous track renewal operation, when the rear of the carrier frame is supported on the ballast bed by off-track undercarriage 8. Furthermore, this arrangement makes it possible to continue the desired ballast distribution without difficulty at the end of the operation until rear undercarriage 7 is in engagement with the track.

What is claimed is:

1. A mobile apparatus for continuously laying a succession of ties, comprising (a) a bridge-like elongated carrier frame, (b) at least one undercarriage supporting the carrier frame, (c) an arrangement for excavating ballast from a bed and for smoothing the ballast bed, the ballast excavating arrangement including (1) a chain guide including a transversely extending guide section mounted on the carrier frame, the chain guide enclosing a space and rising from the transverse guide section adjacent the ballast bed to an upper portion, and (2) an endless ballast excavating chain supported for movement in the chain guide, and (d) means for conveying and laying the succession of ties in a position extending transversely to the carrier frame, the tie conveying and laying means having a path extending through the space enclosed by the chain guide.

2. The mobile apparatus of claim 1, comprising two on-track undercarriages and an off-track track laying undercarriage selectively supporting the carrier frame.

3. The mobile apparatus of claim 1, further comprising a ballast cleaning screen arrangement mounted to receive the excavated ballast from the endless ballast excavating chain adjacent the upper portion of the chain guide and a ballast conveying means mounted to receive the screened ballast from the screen and to distribute the same.

4. The mobile apparatus of claim 1, wherein the means for conveying and laying ties includes a conveyor mounted on the carrier frame and arranged to convey successive ones of the ties in a direction substantially parallel to the elongation of the carrier frame, turntable means arranged to receive the successive ties from the conveyor and to turn the same into a position extending transversely to the carrier frame, and a tie laying device arranged to receive the successively turned ties and to lay them on the ballast bed.

5. The mobile apparatus of claim 1, further comprising means for removing ties from the ballast bed and for conveying the removed ties.

6. The mobile apparatus of claim 1, wherein the space enclosed by the chain guide comprises a substantially rectangular section adjacent the transverse guide section and having a width exceeding the length of the ties, and an adjoining triangular section adjacent the upper portion of the chain guide, and further comprising a drive mounted at the upper portion for moving the endless ballast excavating chain in the guide.

7. The mobile apparatus of claim 1, further comprising an off-track track laying undercarriage selectively supporting the carrier frame and positioned within the space enclosed by the chain guide, the means for laying ties in a position extending transversely to the carrier frame being arranged immediately adjacent the upper portion of the chain guide between the chain guide upper portion and the track laying undercarriage.

8. The mobile apparatus of claim 1, wherein the space enclosed by the chain guide is substantially rectangular, the rectangular space having a width exceeding the length of the ties, and further comprising a pair of drives for moving the endless ballast excavating chain in the guide, each of the drives being mounted in a respective corner of the rectangular space at the upper portion of the chain guide, and ballast outlet means positioned between the drives in the upper portion of the chain guide.

9. The mobile apparatus of claim 8, wherein one of the undercarriages supporting the carrier frame is an on-track undercarriage supporting one end of the carrier frame adjacent the upper portion of the chain guide, and further comprising ballast distributing chute means associated with the ballast outlet means for receiving ballast therefrom, the ballast distributing chute means being arranged between the on-track undercarriage and the means for laying ties in a position extending transversely to the carrier frame, and being disposed to distribute the ballast in two strips extending along the ends of the ties.

10. The mobile apparatus of claim 8, wherein the ballast outlet means comprises outlets in the upper portion of the chain guide respectively positioned in the end regions thereof, and further comprising an adjustable gate for at least one of the outlets.

11. The mobile apparatus of claim 1, wherein the chain guide comprises two elongated sections extending in the direction of the carrier frame elongation and a transverse section at the upper portion, the space enclosed by the chain guide being substantially rectangular, and pivots interconnecting the elongated chain guide sections to the transverse section, the pivots being spaced a distance at least equal to the length of the ties.

12. The mobile apparatus of claim 1, wherein the spaced enclosed by the chain guide is substantially rectangular and the chain guide comprises another transversely extending guide section at the upper portion, and further comprising means for adjusting the length of at least one of the transversely extending guide sections to exceed that of the ties.

13. The mobile apparatus of claim 12, wherein the adjustable transversely extending guide section consists of telescopingly interengaging parts slidable in relation to each other for adjusting the length of the guide section.

14. In a mobile apparatus for continuously replacing old ties by new ties as the apparatus advances along a right of way including an old track section, a new track section and an intermediate trackless ballast bed section wherein the old ties are replaced by new ties:

(a) a first bridge-like elongated carrier frame,
(b) on-track undercarriages supporting the first carrier frame on the old track section,
(c) conveyor means for transporting the old and new ties mounted on the first carrier frame,
(d) a like, second bridge-like elongated carrier frame,
(e) an on-track undercarriage supporting the second carrier frame on the old track section, another on-track undercarriage supporting the second carrier frame on the new track section and an off-track track laying undercarriage selectively supporting the second carrier frame on the intermediate trackless section,
(f) means for coupling the first and second carrier frames together for common advance along the right of way,
(g) an arrangement for excavating ballast from the intermediate trackless section and for smoothing this section, the ballast excavating arrangement including
  (1) a chain guide including a transversely extending guide section mounted on the second carrier frame, the chain guide enclosing a space and rising from the transverse guide section adjacent the intermediate trackless section to an upper portion, and
  (2) an endless ballast excavating chain support for movement in the chain guide,
(h) conveyor means mounted on the second carrier frame for transporting the old ties to and the new ties from the conveyor means on the first carrier frame, and conveyor means being arranged to convey successive ones of the ties in a direction substantially parallel to the elongation of the carrier frames,
(i) a pick-up device for the old ties mounted on the second carrier frame,
(j) turntable means arranged between the pick-up device and the conveyor means for the old ties, the turntable means turning the picked-up old ties into a position extending substantially parallel to the elongation of the carrier frames, (k) a tie laying device for the new ties mounted on the second carrier frame within the space enclosed by the chain guide, and (l) another turntable means arranged between the tie laying device and the conveyor means for the new ties, the other turntable means being arranged to receive successive ones of the new ties from the conveyor means and to turn the same into a position extending transversely to the carrier frames, the tie laying device being arranged to receive the turned new ties from the other turntable means.

15. In the mobile apparatus of claim 14, the conveyor means comprising a conveyor for transporting the new ties and a conveyor transporting the old ties, the conveyors being mounted on the second carrier frame in superposed relationship, the conveyor for transporting the new ties extending in a plane above that of the conveyor for transporting the old ties from the space enclosed by the chain guide towards the first carrier frame, and drive means for moving the conveyors in opposite directions.

16. In the mobile apparatus of claim 14, the chain guide comprising a trough-like portion for the excavated ballast, the excavating chain moving the ballast in the chain guide from the transversely extending guide section to the upper portion thereof, ballast outlet means in the upper portion, and the conveyor means for transporting the new ties intersecting the upper chain guide portion in the region between the off-track track laying undercarriage and the on-track undercarriage.

17. In the mobile apparatus of claim 14, an auxiliary on-track bogie mounted on the second carrier frame immediately adjacent the chain guide between the off-track track laying undercarriage and the on-track undercarriage supporting the second carrier frame on the old track.

18. In the mobile apparatus of claim 17, means for mounting the auxiliary on-track bogies for movement transversely of the elongation of the second carrier frame.

19. In the mobile apparatus of claim 14, means for picking up and removing tie fastening elements arranged forwardly of the arrangement for excavating ballast.

20. In the mobile apparatus of claim 19, the tie fastening element pick-up and removing means comprising a magnetic roll.

* * * * *